US012685333B2

(12) United States Patent
Bray et al.

(10) Patent No.: US 12,685,333 B2
(45) Date of Patent: Jul. 21, 2026

(54) CUTTING AND ARRANGING RODS FOR TOBACCO INDUSTRY PRODUCTS

(71) Applicant: British American Tobacco (Investments) Limited, London (GB)

(72) Inventors: Andrew Jonathan Bray, London (GB); Gerhard Le Roux, Paarl (CA); Gary Fallon, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 18/200,706

(22) Filed: May 23, 2023

(65) Prior Publication Data

US 2023/0292815 A1 Sep. 21, 2023

Related U.S. Application Data

(63) Continuation of application No. 16/098,148, filed as application No. PCT/GB2017/051371 on May 17, 2017, now Pat. No. 11,744,280.

(30) Foreign Application Priority Data

May 19, 2016 (GB) ..... 1608810

(51) Int. Cl.
*A24C 5/47* (2006.01)
*A24C 5/28* (2006.01)
(Continued)

(52) U.S. Cl.
CPC ..... *A24C 5/336* (2013.01); *A24C 5/28* (2013.01); *A24C 5/327* (2013.01); *A24C 5/472* (2013.01); *A24C 5/475* (2013.01); *A24C 5/471* (2013.01)

(58) Field of Classification Search
CPC ..... A24C 5/28; A24C 5/336
See application file for complete search history.

(56) References Cited

U.S. PATENT DOCUMENTS 2,916,038 A 12/1959 Wade
2,929,489 A * 3/1960 Parrish ..... A24C 5/336 198/405
(Continued)

FOREIGN PATENT DOCUMENTS

DE 690346 3/1957
EP 0580150 A1 1/1994
(Continued)

OTHER PUBLICATIONS

European Search Report for corresponding application EP23190018; Mail date Dec. 19, 2023.
(Continued)

*Primary Examiner* — Russell E Sparks
(74) *Attorney, Agent, or Firm* — CANTOR COLBURN LLP

(57) ABSTRACT

The present disclosure relates to an apparatus for cutting and arranging rods for use in a tobacco industry product assembly machine. The apparatus comprises a first cutting mechanism for cutting a four-length rod into first and second axially-aligned double-length rods. Each double-length rod has respective remote ends. A positioning mechanism for moving at least one of the first and second double-length rods such that said first and second double-length rods are moved from a first configuration in axial-alignment, to a second configuration in which the first and second double-length rods are out of axial alignment and the axes of the first and second double-length rods are parallel and spaced apart, and the remote ends of said first and second double-length rods are substantially aligned with each other. Also disclosed
(Continued)

is a method of cutting and arranging rods for tobacco industry product assembly, and a method of tobacco industry product assembly.

13 Claims, 5 Drawing Sheets

(51) Int. Cl.
*A24C 5/32* (2006.01)
*A24C 5/33* (2006.01)

(56) References Cited

U.S. PATENT DOCUMENTS

| | | | | |
|---|---|---|---|---|
| 3,215,250 | A | 11/1965 | Schubert | |
| 3,219,167 | A | 11/1965 | Boinnard | |
| 3,372,702 | A | 3/1968 | Bohn | |
| 3,815,612 | A | 6/1974 | Molins | |
| 4,090,602 | A | 5/1978 | Schubert | |
| 4,483,351 | A | 11/1984 | Seragnoli | |
| 4,841,993 | A | 6/1989 | Hinz | |
| 5,425,383 | A | 6/1995 | Garthaffner | |
| 5,666,976 | A | 9/1997 | Adams | |
| 6,354,300 | B1 | 3/2002 | Schlisio | |
| 11,744,280 | B2 * | 9/2023 | Bray | A24C 5/28 131/282 |
| 2002/0119874 | A1 | 8/2002 | Heitmann | |
| 2002/0174873 | A1 | 11/2002 | Schlisio | |
| 2004/0237972 | A1 | 12/2004 | Horn | |
| 2006/0052226 | A1 | 3/2006 | Rinke | |
| 2011/0008042 | A1 | 1/2011 | Stewart | |
| 2011/0023900 | A1 | 2/2011 | Clarke | |

FOREIGN PATENT DOCUMENTS

| | | | |
|---|---|---|---|
| EP | 0895724 | A1 | 10/1999 |
| GB | 664690 | | 12/1949 |
| GB | 960346 | | 3/1957 |
| GB | 818440 | | 8/1959 |
| GB | 929270 | | 10/1959 |
| GB | 1024281 | | 6/1963 |
| GB | 979088 | | 1/1965 |
| GB | 1095529 | | 12/1967 |
| GB | 1583733 | | 2/1981 |
| WO | 2012168919 | A1 | 12/2012 |
| WO | 2013164124 | A1 | 11/2013 |
| WO | 2015140742 | A1 | 9/2015 |

OTHER PUBLICATIONS

Indian Office Action for corresponding application 201847042796; Mail date Feb. 11, 2020.

International Preliminary Report on Patentability for corresponding application PCT/GB2017/051371 filed May 17, 2017; Mail date Jul. 28, 2017.

International Search Report for corresponding application PCT/GB2017/051371 filed May 17, 2017; Mail date Jul. 28, 2017.

Written Opinion of the International Searching Authority for corresponding application PCT/GB2017/051371 filed May 17, 2017; Mail date Jul. 28, 2017.

Notice of Opposition for corresponding European application EP17725730.0; Dated May 12, 2021.

European Office Action for corresponding application 23 190 018.4; Report dated Oct. 16, 2025.

* cited by examiner

CUTTING AND ARRANGING RODS FOR TOBACCO INDUSTRY PRODUCTS

CROSS REFERENCE TO RELATED APPLICATIONS

This application is a continuation of U.S. patent application Ser. No. 16/098,148 which was filed on Nov. 1, 2018 as the U.S. National Stage of International Patent Application Number PCT/GB2017/051371 filed on May 17, 2017, claiming priority to UK Patent Application Number 1608810.6 filed on May 19, 2016, the contents of all of which said applications are incorporated herein by reference in their entireties.

TECHNICAL FIELD

Embodiments of the invention relate to an apparatus for cutting and arranging rods for tobacco industry products, such as rods of smokeable material, and to a method of cutting and arranging such rods. Embodiments of the invention also relate to a tobacco industry product assembly machine, such as a smoking article assembly machine and to a method of assembling a tobacco industry product.

BACKGROUND

It is known to provide apparatuses for cutting and arranging rods for tobacco industry products such as smoking articles, for example tobacco rods. These apparatuses typically comprise a series of drums configured to transport, cut and/or arrange tobacco rods. The tobacco rods are then assembled with one or more filter elements and subsequently wrapped to form a smoking article.

SUMMARY

In accordance with some embodiments described herein, there is provided an apparatus for cutting and arranging rods for use in a tobacco industry product assembly machine, the apparatus comprising a first cutting mechanism for cutting a four-length rod into first and second axially-aligned double-length rods, each double-length rod having respective remote ends, and a positioning mechanism for moving at least one of the first and second double-length rods such that said first and second double-length rods are moved from a first configuration in axial-alignment, to a second configuration in which the first and second double-length rods are out of axial alignment and the axes of the first and second double-length rods are parallel and spaced apart, and the remote ends of said first and second double-length rods are substantially aligned with each other.

The positioning mechanism may comprise a turning mechanism configured to rotate said first double-length rod into alignment with said second double-length tobacco rod so that the first and second double-length rods are arranged the second configuration.

Said turning mechanism may comprise at least one pivoting arm for rotating said first double-length tobacco rod into alignment with said second double-length tobacco rod so that the first and second double-length rods are arranged the second configuration.

Said first cutting mechanism may comprise a cutting drum. Said positioning mechanism may comprise a positioning drum.

Said apparatus may be configured to provide said first and second double-length tobacco rods, each having a longitudinal length in the range of 60-100 millimetres, and optionally in the range of 70-100 millimetres, and optionally in the range of 80-100 millimetres, and optionally of 84 millimetres.

In accordance with some embodiments described herein, there is also provided a tobacco industry product assembly machine comprising an apparatus as described above.

The tobacco industry product assembly machine may comprise a rod making station disposed upstream of the first cutting mechanism and configured to produce said four-length rods to be provided to the first cutting mechanism.

The tobacco industry product assembly machine may comprise a transfer station disposed between said rod making station and said first cutting mechanism and configured to convey said four-length rods from said rod making station towards said first cutting mechanism.

The tobacco industry product assembly machine may further comprise a receiving station upstream of the first cutting mechanism and configured to transfer said four-length rods to the first cutting mechanism, and wherein the receiving station comprises a receiving drum.

The tobacco industry product assembly machine may comprise a second cutting mechanism downstream of the first cutting mechanism, for cutting said first and second double-length tobacco rods into single-length tobacco rods.

The tobacco industry product assembly machine may further comprise a tipping station downstream of the second cutting station, configured to join at least one further component of said tobacco industry product to said single-length tobacco rods with a tipping paper so as to form tobacco industry product assemblies.

The tobacco industry product assembly machine may further comprise a third cutting station downstream of the tipping station, configured to cut the tobacco industry product assemblies at a mid-point of the at least one further component so as to form tobacco industry products.

In accordance with some embodiments described herein, there is also provided a method of cutting and arranging rods for tobacco industry product assembly, the method comprising providing a four-length rod, cutting said four-length rod into first and second double-length rods, each double-length rod having respective remote ends, and positioning said first and second double-length tobacco rods by moving at least one of the first and second double-length rods from a first configuration in which they are axially aligned, to a second configuration in which the first and second double-length rods are out of axial alignment and the axes of the first and second double-length rods are parallel and spaced apart, and the remote ends of said first and second double-length rods are substantially aligned with each other.

Positioning said first and second double-length rods adjacent to each other may comprise rotating said first double-length rod into alignment with said second double-length rod so that the first and second double-length rods are arranged the second configuration.

Rotating said first double-length rod may comprise using at least one pivoting arm for rotating said first double-length rod into alignment with said second double-length rod so that the first and second double-length rods are arranged the second configuration.

Rotating said first double-length rod may comprise rotating said first double-length rod by an angle of about 180 degrees around an axis substantially perpendicular to the longitudinal axis of said second double-length rod.

The method may comprise providing said first and second double-length rods having a longitudinal length in the range of 60-100 millimetres, and optionally in the range of 70-100 millimetres, and optionally in the range of 80-100 millimetres, optionally of 84 millimetres.

In accordance with some embodiments described herein, there is also provided a method of assembling a tobacco industry product, comprising cutting and arranging rods according to the method described above, and cutting said first and second double-length rods into single-length rods.

The method may further comprise joining at least one further component of tobacco industry product manufacture to said single-length rods so as to form tobacco industry product assemblies.

The method may further comprise cutting the tobacco industry product assemblies at a mid-point of the at least one further component so as to form tobacco industry products.

The rods cut and arranged using the apparatus and methods disclosed herein may advantageously comprise rods of smokeable material, and may be rods of tobacco.

BRIEF DESCRIPTION OF THE DRAWINGS

Embodiments of the invention will now be described, by way of example only, with reference to the accompanying drawings in which.

DETAILED DESCRIPTION

Figure 1:
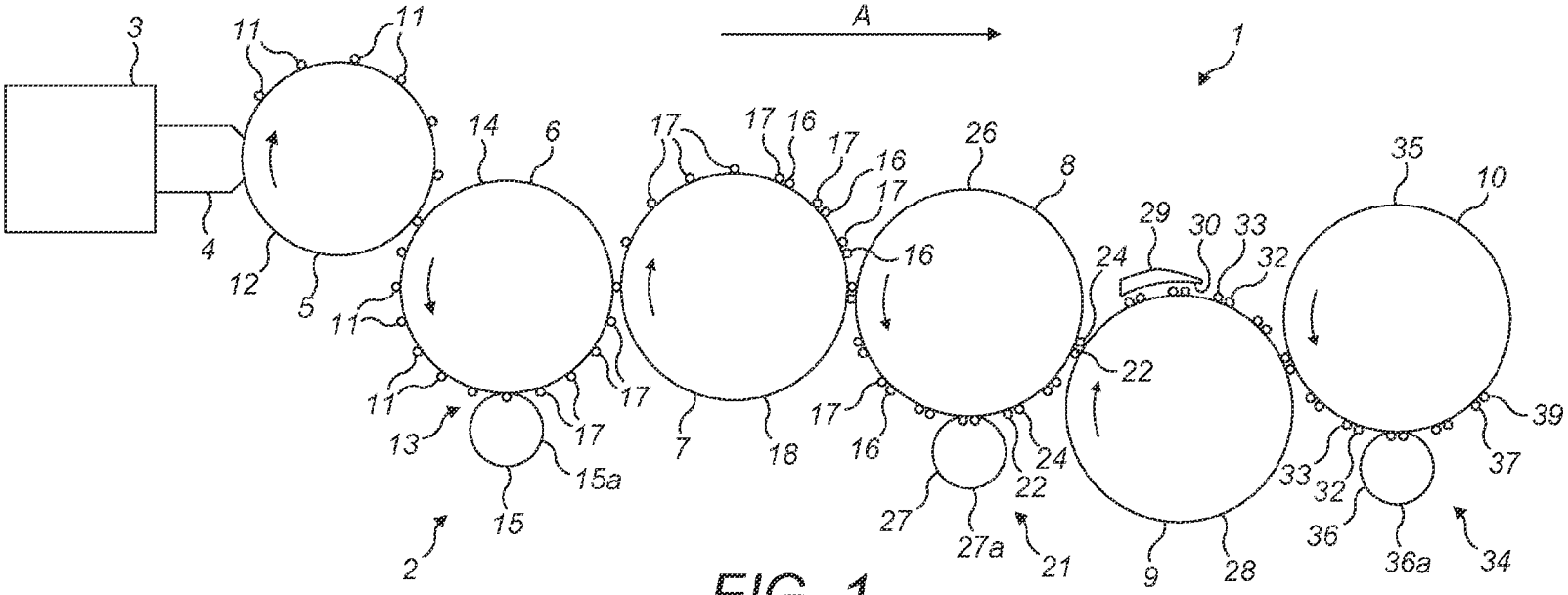
FIG. 1 shows a schematic illustration of a smoking article assembly machine comprising an apparatus for cutting and arranging tobacco rods according to an embodiment of the invention.

Referring now to the Figures, FIG. 1 shows a schematic illustration of a machine 1 for assembling tobacco industry products, and particularly smoking articles (and referred to hereinafter as "smoking articles"), comprising an apparatus 2 for cutting and arranging tobacco rods in accordance with an embodiment of the invention.

The apparatus 2 comprises a first cutting station 6 and a positioning station 7. The machine 1 comprises the apparatus 2, in addition to a tobacco rod making station 3 and a transfer station 4 and a receiving station 5 upstream of the apparatus 2. The machine 1 further comprises, downstream of the apparatus 2, a second cutting station 8, a tipping station 9, and a third cutting station 10. The receiving station 5, the first cutting station 6, the positioning station 7, the second cutting station 8, the tipping station 9 and the third cutting station 10 comprise a series of drums configured to arrange and/or cut and/or transfer and/or assemble smoking articles or components of smoking articles. In use, the smoking articles produced by the machine 1 and the components for forming such smoking articles are conveyed generally from left to right in FIG. 1, in the manufacturing path direction shown by arrow A. The components of are conveyed along the manufacturing path as the drums rotate. The components are transferred from one drum to the next at a point where the circumferential surfaces of the drums are closest to each other. Each station will now be described in more detail.

The tobacco rod making station 3 is configured to produce four-length ("4-up") tobacco rods 11. The tobacco rod making station 3 is configured to produce four-length tobacco rods 11 having a longitudinal length in the range of 120-200 millimetres, and may be in the range of 140-200 millimetres, and may be in the range of 160-200 millimetres, in particular of about 168 millimetres. The tobacco rod making station 3 is disposed upstream of the transfer station 4 and the receiving station 5 such that the tobacco rod making station 3 is configured to provide the four-length tobacco rods 11 to the receiving station 5, via the transfer station 4.

The transfer station or spider unit 4 is disposed between the tobacco rod making station 3 and the receiving station 5. The transfer station 4 is configured to transfer the four-length tobacco rods 11 from the tobacco rod making station 3 to the receiving station 5. The transfer station 4 is configured to pick up the four-length tobacco rods 11 and deposit the four-length tobacco rods 11 on the receiving station 5. In an alternative embodiment of the invention, the transfer station 4 may be omitted and the four-length tobacco rods 11 may be transferred directly from the tobacco rod making station 3 to the receiving station 5.

The receiving station 5 is configured to transport the four-length tobacco rods 11 towards the first cutting station 6. The receiving station 5 is in the form of a rotatable receiving drum 12. The receiving station 5 may be formed with flutes or grooves (not shown) for receiving the tobacco rods 11, each groove having valve-operated holes through which suction can be applied to the tobacco rods 11 received in the grooves such that the tobacco rods 11 can be retained in their respective grooves as the receiving drum 12 rotates.

The first cutting station 6 comprises a first cutting mechanism 13 comprising a first cutting drum 14 and a first cutting element 15 in the form of a first cutting wheel 15*a*, as illustrated in FIG. 1. The first cutting wheel 15*a* is in the form of a circular blade and rotates in engagement with the first cutting drum 14. For example, the first cutting wheel 15*a* may contact an outer surface of the first cutting drum 14 or may be partially received within a recess formed in the outer surface of the first cutting drum 14. The first cutting mechanism 13 is configured to cut each four-length tobacco rod 11 into first and second double-length ("2-up") tobacco rods 16, 17. The first cutting mechanism 13 is configured to provide first and second double-length tobacco rods 16, 17, each having a longitudinal length in the range of 60-100 millimetres, and may be in the range of 70-100 millimetres, and may be in the range of 80-100 millimetres, in particular of about 84 millimetres. The first cutting drum 14 may be formed with grooves or flutes (not shown) for receiving the tobacco rods, each groove having holes through which suction can be selectively applied to the tobacco rods 16, 17 received in the grooves such that the tobacco rods 16, 17 can be retained in their respective grooves as the first cutting drum 14 rotates.

To ensure the rods are aligned accurately in the flutes of the first cutting drum 14, the first cutting drum 14 includes alignment plates or "swash plates" (not shown) at each end of the first cutting drum 14. These swash plates are known and so will not be described in detail here, but briefly, comprise moveably plates mounted to the first cutting drum 14 at each end thereof, and which are deflectable towards and away from the first cutting drum 14. The swash plates are spaced from the ends of the first cutting drum 14 at the position where the four-length tobacco rods 11 are fed onto the first cutting drum 14. As the first cutting drum 14 rotates, an alignment mechanism deflects the swash plates towards the first cutting drum 14 and they contact the respective end of any four-length tobacco rod 11 that may be protruding from a flute, to nudge the four-length tobacco rod 11 into the correct position within the flute. Therefore, by the four-length tobacco rods 11 reach the first cutting wheel 15*a* as the first cutting drum 14 rotates, the four-length tobacco rod 1 is precisely centrally aligned in the respective flute of the first cutting drum, between the swash plates.

The positioning station 7 comprises a rotatable positioning drum, or tip-turning drum 18 which rotates adjacent the first cutting drum 14. As with the first cutting drum 14, the positioning drum 18 may be formed with grooves or flutes (described below) for receiving the tobacco rods 16, 17, each groove having holes (not shown) through which suction can be selectively applied to the tobacco rods 16, 17 received in the grooves such that the tobacco rods 16, 17 can be retained in their respective grooves as the positioning drum 18 rotates. The tobacco rods 16, 17 are transferred from the first cutting drum 14 to the positioning drum 18 at a point where the circumferential surfaces of the two drums 14, 18 are closest to each other. At the position where the first cutting drum 14 rotates closest to the positioning drum 18, the suction acting on the tobacco rods 16, 17 from the first cutting drum 14 is released and suction of the positioning drum 18 is activated, such that the tobacco rods 16, 17 are transferred from the first cutting drum 14 to the positioning drum 18.

Figure 2:
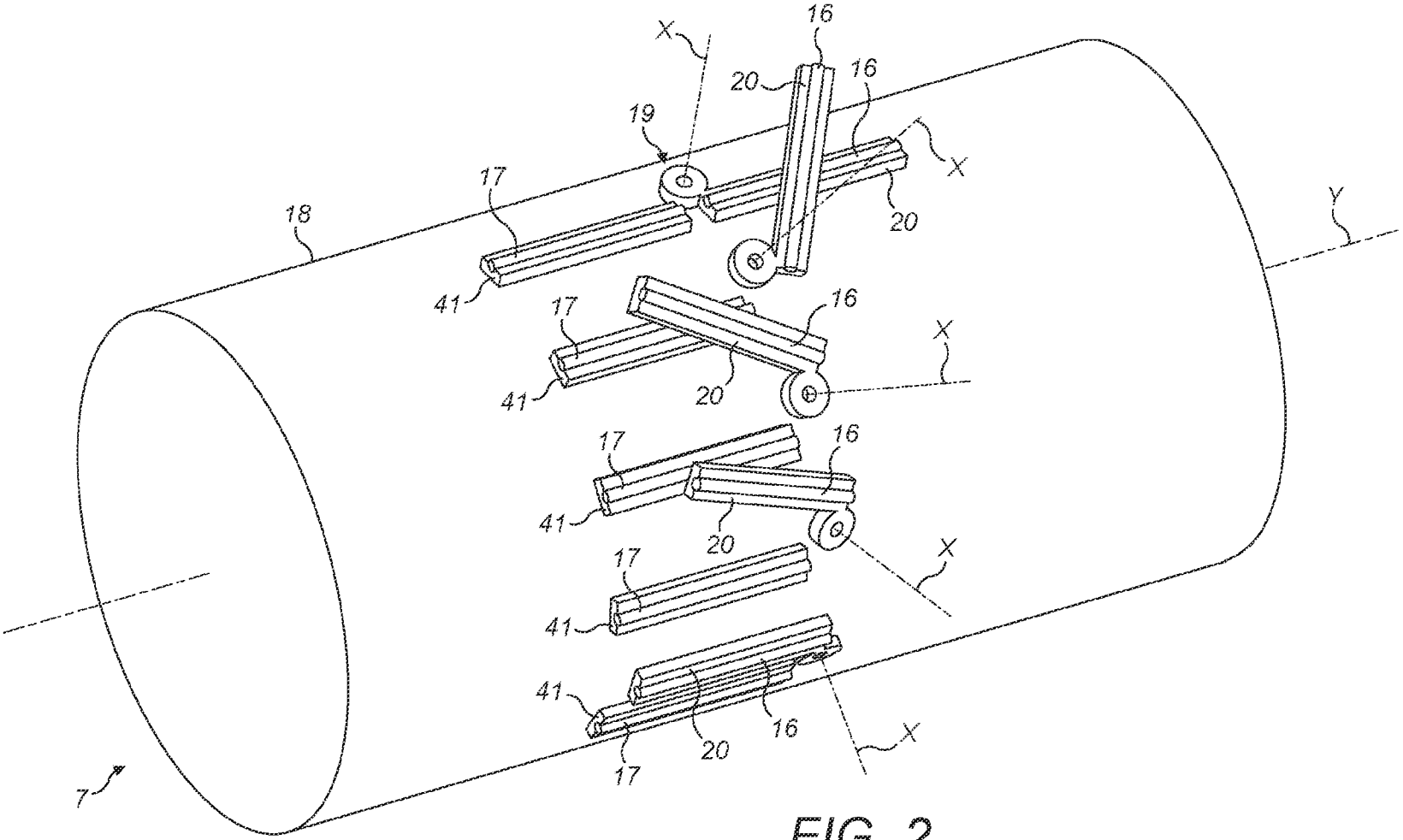
FIG. 2 shows a schematic illustration in perspective view of a positioning drum forming part of the apparatus for cutting and arranging tobacco rods according to an embodiment of the invention.

The positioning drum 18 comprises a positioning mechanism 19 in the form of a turning mechanism 19 (shown in FIG. 2) configured to arrange the first and second double-length tobacco rods 16,17 adjacent to each other such that the ends of the first and second double-length tobacco rods 16, 17 are substantially aligned with each other, and the axes of the first and second double-length tobacco rods 16, 17 are parallel but spaced from each other in a rotational direction of the positioning drum 18. In particular, the turning mechanism 19 is configured to pivot the first double-length tobacco rod 16 into alignment with the second double-length tobacco rod 17. The turning mechanism 19 is configured to turn the first double-length tobacco rod 16 so that the first double-length tobacco rod 16 and the second double-length tobacco rod 17 are positioned parallel and adjacent to each other. As shown in FIG. 2, the turning mechanism 19 comprises a series of pivoting arms 20 distributed along the circumference of the positioning drum 18 and configured to receive the first double-length tobacco rods 16. The positioning drum 18 further comprises a series of stationary rod seats 41 which are configured to receive the second double length tobacco rods 17. One stationary rod seat 41 is associated with each pivoting arm 20. The stationary rod seats 41 are fixed relative to the main body of the positioning drum 18. The pivoting arms 20 and stationary rod seats 41 both include said grooves or flutes described above to receive the tobacco rods 16, 17. The suction holes (not shown) to retain the first and second tobacco rods 16, 17 in the grooves are therefore formed in the pivoting arms 20 and stationary rod seats 41.

Each pivoting arm 20 is configured to pivot about a pivot axis ('X' in FIG. 2) substantially perpendicular to a rotation axis ('Y' in FIG. 2) of the positioning drum 18. Each pivoting arm 20 is configured to rotate the first double-length tobacco rod 16 by an angle of about 180 degrees around the pivot axis. The pivot axis extends along a direction substantially perpendicular to the longitudinal axis of the second double-length tobacco rod 17. Each pivoting arm 20 is moveable between a first position and a second position. In the first position, the groove of the pivoting arm 20 is in longitudinal alignment with the groove in the associated stationary rod seat 41, such that the first and second double-length tobacco rods 16, 17 are in a first configuration in which the first double-length tobacco rod 16 received in the groove of the pivoting arm is substantially coaxial with the second double length tobacco rod 17 received in the groove of the associated stationary rod seat 41. In the second position, the groove of the pivoting arm 20 is parallel to, but spaced from the groove in the associated stationary rod seat 41 in a rotational direction of the positioning drum 18. In the second position, the first and second double-length tobacco rods 16, 17 are in a second configuration in which the first double-length tobacco rod 16 received in the groove of the pivoting arm 20 is out of axial alignment with the second double length tobacco rod 17 received in the groove of the associated stationary rod seat 41, and the axes of the first and second double-length rods 16, 17 are parallel and spaced apart, and the remote ends of said first and second double-length rods are substantially aligned with each other.

The turning mechanism 19 comprises a mechanical linkage configured to move the pivoting arms 20 between the first and second positions as the positioning drum 18 rotates. Such mechanical linkage may comprise one or more gears, cam tracks and cam followers respectively provided on the positioning drum hub and coupled to the pivoting arms 20. The turning mechanism 19 and mechanical linkage is configured such that as the positioning drum 18 completes a full rotation, each pivoting arm 20 initially moves from the first position where the first and second double-length rods 16, 17 are in the first configuration and how they were received from the first cutting drum 14 to the second position. The pivoting arms 20 remain in the second position for a portion of the rotation of the position drum 18 until the point where the first and second double-length rods 16, 17 are transferred to the second cutting drum 26. Once past the point of transfer to the second cutting drum 26, each pivoting arm 20 moves back to the first position ready to receive further axially-aligned first and second double-length rods 16, 17. The timing of the movement of the pivoting arms 20 between the first and second positions can be determined by the configuration of the mechanical linkage between the positioning drum 18 and the pivoting arms 20. For example, the profile of a cam track within the positioning drum 18 can be shaped to determine at which points in the rotation of the positioning drum 18 the pivoting arms move from the first position to the second position, and then from the second position back to the first position.

The second cutting station 8 comprises a rotatable second cutting drum 26 which rotates adjacent the positioning drum 18. The second cutting drum 26 may be formed with grooves or flutes (not shown) for receiving the tobacco rods 16, 17, each groove having holes through which suction can be selectively applied to the tobacco rods 16, 17 received in the grooves such that the tobacco rods 16, 17 can be retained in their respective grooves as the second cutting drum 26 rotates. The tobacco rods 16, 17 are transferred from the positioning drum 18 to the second cutting drum 26 at a point where the circumferential surfaces of the two drums 18, 26 are closest to each other. At the position where the positioning drum 18 rotates closest to the second cutting drum 26, the suction acting on the tobacco rods 16, 17 from the positioning drum 18 is released and suction of the second cutting drum 26 is activated, such that the tobacco rods 16, 17 are transferred from the positioning drum 18 to the second cutting drum 26.

The second cutting station 8 comprises a second cutting mechanism 21. The second cutting mechanism 21 is configured to cut the first and second double-length tobacco rods 16, 17 into single-length ("1-up") tobacco rods 22, 23, 24, 25. The second cutting mechanism 21 is configured to provide single-length tobacco rods 22, 23, 24, 25, each having a longitudinal length in the range of 30-50 millimetres, and may be in the range of 35-50 millimetres, and may be in the range of 40-50 millimetres, in particular of about 42 millimetres. The second cutting mechanism 21 comprises the second cutting drum 26 and a second cutting element 27. The second cutting element 27 comprises a second cutting wheel 27*a* rotatable about its own central axis. The second cutting wheel 27*a* is in the form of a circular blade and rotates in engagement with the second cutting drum 26. For example, the second cutting wheel 27*a* may contact an outer surface of the second cutting drum 26 or may be partially received within a recess formed in the outer surface of the second cutting drum 26. The second cutting wheel 27*a* is configured to cut the first and second double-length tobacco rods 16, 17 in half. The second cutting drum 26 may similarly comprise swash plates (not shown) as with the first cutting drum 14, to ensure the first and second double-length tobacco rods 16, 17 are accurately positioned on the second cutting drum before being cut in half by the second cutting wheel 27*a*.

The tipping station 9 comprises a rotatable rolling drum 28 which rotates adjacent the second cutting drum 26. The rolling drum 28 may be formed with grooves or flutes (not shown) for receiving the tobacco rods 22-25, each groove having holes through which suction can be selectively applied to the tobacco rods 22-25 received in the grooves such that the tobacco rods 22-25 can be retained in their respective grooves as the rolling drum 28 rotates. The tobacco rods 22-25 are transferred from the second cutting drum 26 to the rolling drum 28 at a point where the circumferential surfaces of the two drums 26, 28 are closest to each other. At the position where the second cutting drum 26 rotates closest to the rolling drum 28, the suction acting on the tobacco rods 22-25 from the second cutting drum 26 is released and suction of the rolling drum 28 is activated, such that the tobacco rods 22-25 are transferred from the second cutting drum 26 to the rolling drum 28.

Figure 3A:
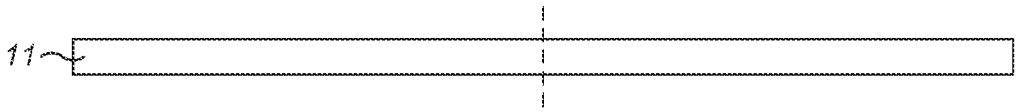
FIGS. 3*a* to 3*h* show schematic illustrations of assembly stages of a smoking article assembled by means of the smoking article assembly machine according to an embodiment of the invention.
Figure 3B:
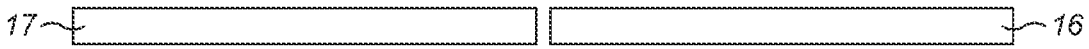
Figure 3C:
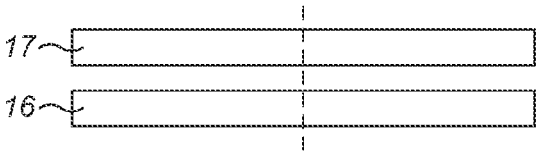
Figure 3D:
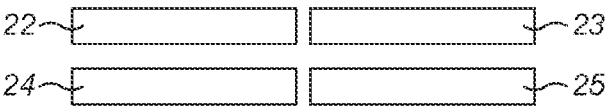
Figure 3E:
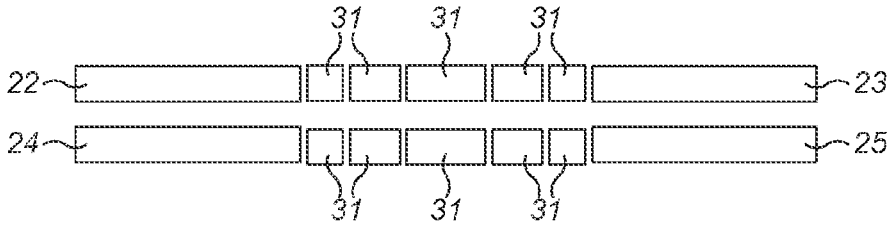
Figure 3F:
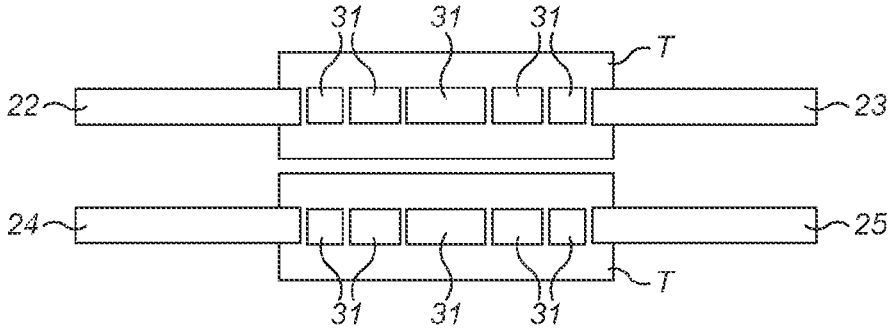

The tipping station 9 as illustrated in FIG. 1 comprises the rolling drum 28 and a rolling hand 29 which together define a space or a channel 30 through which the single-length tobacco rods 22, 23, 24, 25 pass such that they are enclosed in a tipping paper T (represented in FIG. 3*f*). The rolling drum 28 rotates about an axis and the rolling hand 29 is stationary. The tipping station 9 is configured to space the single-length tobacco rods 22, 23, 24, 25 apart from each other and to place one or more further components 31, such as filter components (represented in FIG. 3*e*), such as filter components, between the single-length tobacco rods 22, 23, 24, 25, and to then join the single-length tobacco rods 22, 23, 24, 25 and further components 31 to form smoking article assemblies 32, 33 (represented in FIG. 3*g*). Those skilled in the art will be aware of various tipping stations and associated machinery and so it will not be described in detail here. However, in summary, the tipping paper patch T is transferred to the tobacco rods 22-25 and filter components 31 on the rolling drum 28 and adhesive anchors the tipping paper patch T to the tobacco rods 22-25 and filter components 31. The tipping paper patch T may be transferred to the tobacco rods 22—and filter components 31 on a separate tipping drum (not shown) before the tobacco rods 22-25 and filter components 31 with attached tipping paper patch T are then transferred to the rolling drum 28 in a same manner as described above with reference to smoking article component transfer between drums along the manufacturing path. The tobacco rods 22-25 and filter components 6 and the tipping paper patch T enter the space between the rolling drum 28 and the rolling hand 29 are rolled over the outer curved surface of the rolling drum 28 by frictional contact with the opposing face of the rolling hand 29, thereby wrapping the tipping paper patch T around the tobacco rods 22-25 and filter components 31 to join them together.

The third cutting station 10 comprises a rotatable cutting drum 35 which rotates adjacent the rolling drum 28. The third cutting drum 35 may be formed with grooves or flutes (not shown) for receiving the smoking article assemblies 32, 33. Each groove may have holes through which suction can be selectively applied to the smoking article assemblies 32, 33 received in the grooves such that the smoking article assemblies 32, 33 can be retained in their respective grooves as the third cutting drum 35 rotates. The smoking article assemblies 32, 33 are transferred from the rolling drum 28 to the third cutting drum 35 at a point where the circumferential surfaces of the two drums 28, 35 are closest to each other. At the position where the rolling drum 28 rotates closest to the third cutting drum 35, the suction acting on the smoking article assemblies 32, 33 from the rolling drum 28 is released and suction of the third cutting drum 35 is activated, such that the smoking article assemblies 32, 33 are transferred from the rolling drum 28 to the third cutting drum 35.

The third cutting station 10 comprises a third cutting mechanism 34. The third cutting mechanism 34 comprises the third cutting drum 35 and a third cutting element 36. The third cutting element 36 comprises a third cutting wheel 36*a* rotatable about its own central axis. The third cutting wheel 36*a* is in the form of a circular blade and rotates in engagement with the third cutting drum 35. For example, the third cutting wheel 36*a* may contact an outer surface of the third cutting drum 35 or may be partially received within a recess formed in the outer surface of the third cutting drum 35. The third cutting wheel 36*a* is configured to cut the wrapped smoking article assemblies 32, 33 prepared at the tipping station 9 in half. The cut is made at the mid-point of a central filter component 31, to produce identical and equal-length smoking articles 37, 38, 39, 40. The third cutting drum 35 may similarly comprise swash plates (not shown) as with the first and second cutting drums 14, 26, to ensure the smoking article assemblies 32, 33 are accurately positioned on the third cutting drum before being cut in half by the third cutting wheel 36*a*.

The operation of the smoking article assembly machine 1 will now be described with reference to FIGS. 1 and 2. Reference will also be made to the assembly stages of the smoking articles 37, 38, 39, 40 as illustrated in FIGS. 3*a* to 3*h*, and the method flow chart of FIG. 4.

In use, the tobacco rod making station 3 produces a four-length tobacco rod 11 (FIG. 3*a*) and provides the four-length tobacco rod 11 to the transfer station 4. The four-length tobacco rod 11 has, for example, a length of around 168 millimetres. The transfer station 4 picks the four-length tobacco rod 11 and deposits the four-length tobacco rod 11 in a groove of the receiving drum 12. As the receiving drum 12 rotates, the receiving drum 12 transports the four-length tobacco rod 11 towards the first cutting station 6. The first cutting drum 14 then receives the four-length tobacco rod 11, at step S1 in FIG. 4. As the first cutting drum 14 rotates about its axis, the four-length tobacco rod 11 is transferred past the first cutting wheel 15*a* such that the first cutting wheel 15*a* cuts the four-length tobacco rod 11 into two segments or first and second double-length tobacco rods 16, 17 (FIG. 3*b*), at step S2. The dashed line in FIG. 3*a* represents the cutting point of the four-length tobacco rod 11. The formed first and second double-length tobacco rods 16, 17 each have a length of about 84 millimetres.

The first and second double-length tobacco rods 16, 17 are then transferred from the first cutting drum 14 to the positioning drum 18 at step S3. The first double-length tobacco rod 16 locates on a surface of one of the pivoting arms 20. On the positioning drum 18, the first and second tobacco rods 16, 17 are initially aligned along a longitudinal axis parallel to the rotation axis of the positioning drum 18. Then, as the positioning drum 18 rotates, the pivoting arm 20 pivots such that the first double-length tobacco rod 16 rotates by an angle of about 180 degrees around the pivot axis and comes into alignment with the second double-length tobacco rod 17, at step S4. The first and second double-length tobacco rods 16, 17 are therefore arranged substantially parallel and adjacent to each other and the ends of the first and second double-length tobacco rods 16, 17 are substantially aligned with each other (FIG. 3*c*).

Thereafter, each double-length tobacco rod 16, 17 is passed to a groove of the second cutting drum 26 at step S5. As the double length tobacco rods 16, 17 passes the second knife 27*a*, the second knife 27*a* cuts the double-length tobacco rods 16, 17 in half at step S6 to form single-length tobacco rods 22, 23, 24, 25 (FIG. 3*d*). The cuts are illustrated by the dashed lines in FIG. 3*c*.

Then, each single-length tobacco rod 22, 23, 24, 25 locates in a groove of the rolling drum 28 of the tipping station 9. The single-length tobacco rods 22, 23, 24, 25 are spaced apart in an axial direction of the rods 22, 23, 24, 25 at step S7. The components 31, such as the filter components 31, are positioned between the single-length tobacco rods 22, 23, 24, 25 at step S8, and as shown in FIG. 3*e*. The spacing may occur on the rolling drum 28, or in an alternative embodiment, the spacing may occur on a separate spacing drum (not shown) disposed between the second cutting drum 26 and the rolling drum 28 so that the single length tobacco rods 22, 23, 24, 25 are provided to the rolling drum 28 already spaced apart. In either embodiment, the spacing may occur by means of moveable sections on the respective spacing drum or rolling drum 28. In such an arrangement, the pairs of single-length tobacco rods 22, 23, 24, 25 are received on the respective drum in grooves, and as the drum rotates, the sections of the drum respectively holding the adjacent pairs of single-length tobacco rods 22,23, and 24,25 move apart to provide the required spacing for insertion of filter components 31.

Figure 3G:
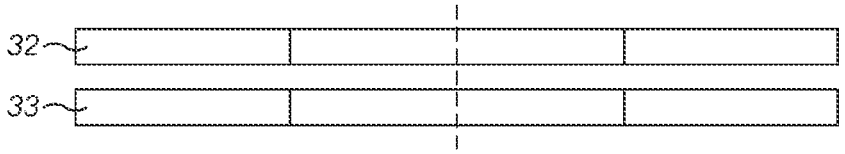
Figure 4:
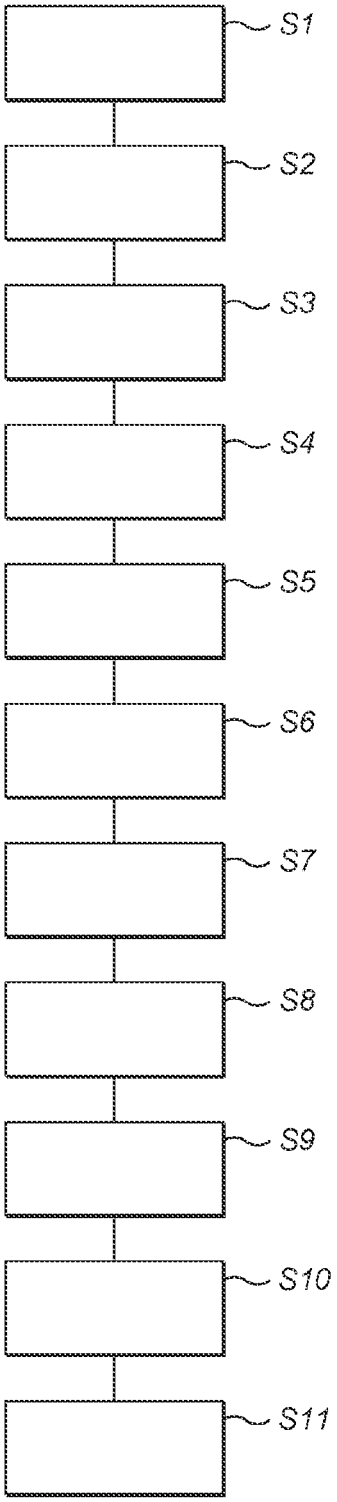
FIG. 4 shows a flow chart schematically illustrating a method of cutting and arranging rods of smokeable material according to an embodiment of the invention.

A tipping paper patch T is provided to each aligned set of single length tobacco rods 22-25 and filter components 31, as shown in FIG. 3*f*. As the single-length tobacco rods 22, 23, 24, 25 pass the rolling hand 29, the single-length tobacco rods 22, 23, 24, 25 are wrapped in the tipping paper T such that the components 31 are joined to the single-length tobacco rods 22, 23, 24, 25 so as to form smoking article assemblies 32, 33 at step S9 (FIG. 3*g*).

Figure 3H:
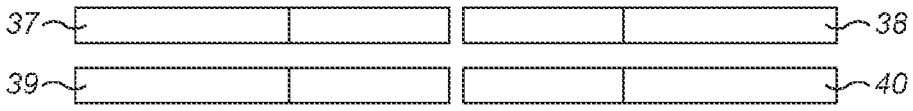

Each wrapped smoking article assembly 32, 33 is then passed to a groove of the third cutting drum 35 at step S10. The smoking article assemblies 32, 33 are cut in half at step S11 to form four smoking articles 37, 38, 39, 40 as illustrated in FIG. 3*h*, wherein each smoking article 37, 38, 39, 40 comprises a single-length tobacco rod 22, 23, 24, 25 and one or more components 31. The cuts are illustrated by the dashed lines in FIG. 3*g*.

Thereafter the smoking articles 37, 38, 39, 40 may be separated using known techniques and then transferred to a packaging station (not shown).

The machine 1 according to the present invention advantageously allows production of single-length tobacco rods which are shorter than the single-length tobacco rods used in conventional cigarettes. Use of such shorter tobacco rods may be required in the manufacturing process of heat-not-burn products.

Although the exemplary turning mechanism 19 described herein is configured to move the first double-length tobacco rod 16 relative to the second double-length tobacco rod 17, the invention is not intended to be limited to the configuration, and in an alternative embodiment, the turning mechanism 19 may be configured to move the second double-length tobacco rod 17 relative to the first double-length tobacco rod 16. In a yet further alternative exemplary embodiment of the invention, the turning mechanism 19 may be configured to move both the first and second double-length tobacco rods 16, 17 from the above-described first configuration in which they are in axially-alignment, to the second configuration in which they are out of axial alignment and their axes are parallel and spaced apart, with their remote ends substantially aligned with each other.

As used herein, the term "tobacco industry product" is intended to include smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products, hybrid systems to generate aerosol from a combination of substrate materials, for example hybrid systems containing a liquid or gel or solid substrate; and aerosol-free nicotine delivery articles such as lozenges, gums, patches, articles comprising breathable powders and smokeless tobacco products such as snus and snuff.

In some embodiments, the tobacco industry product is a non-combustible smoking article. In some embodiment the tobacco industry product is a heating device which releases compounds by heating, but not burning, a substrate material. The material may be for example tobacco or other non-tobacco products, which may or may not contain nicotine. In some embodiments the heating device is a tobacco heating device.

In other embodiments the tobacco industry product is a hybrid system to generate aerosol by heating, but not burning, a combination of substrate materials. The substrate materials may comprise for example solid, liquid or gel which may or may not contain nicotine. In some embodiments, the hybrid system comprises a liquid or gel substrate and a solid substrate. The solid substrate may be for example tobacco or other non-tobacco products, which may or may not contain nicotine. In some embodiments the hybrid system comprises a liquid or gel substrate and tobacco.

In order to address various issues and advance the art, the entirety of this disclosure shows by way of illustration various embodiments in which the claimed invention(s) may be practiced and provide for a superior tobacco industry rod assembly apparatus. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

What is claimed:

1. A tobacco industry product assembly machine (1) comprising an apparatus (2) for cutting and arranging rods for use in a tobacco industry product assembly machine, the apparatus comprising:

a first cutting mechanism (13) for cutting a four-length rod (11) into first and second axially-aligned double-length rods (16,17), each double-length rod having a near end and a remote end, and a positioning mechanism (19) for moving at least one of the first and second double-length rods such that said first and second double-length rods are moved from a first configuration in axial-alignment in which the near ends of the first and second double-length rods are disposed proximal to one another and the remote ends are disposed distally, to a second configuration in which:

the first and second double-length rods are out of axial alignment, the axes of the first and second double-length rods are parallel and spaced apart, the remote end of the first double-length rod is disposed proximal to the remote end of the second double-length rod, and the near end of the first double-length rod is disposed proximal to the near end of the second double-length rod;

wherein the positioning mechanism comprises a turning mechanism (19) configured to rotate said first double-length rod (16) into alignment with said second double-length rod (17) so that the first and second double-length rods are arranged in the second configuration, the tobacco industry product assembly machine further comprising a second cutting mechanism (21) downstream of the first cutting mechanism for cutting said first and second double-length rods into single-length rods (22,23,24,25).

2. The tobacco industry product assembly machine (1) according to claim 1, wherein said turning mechanism (19) comprises at least one pivoting arm (20) for rotating said first double-length rod (16) into alignment with said second double-length rod (17) so that the first and second double-length rods are arranged the second configuration.

3. The tobacco industry product assembly machine (1) according to claim 1, comprising a rod making station (3) disposed upstream of the first cutting mechanism (13) and configured to produce said four-length rods (11) to be provided to the first cutting mechanism.

4. The tobacco industry product assembly machine (1) according to claim 3, comprising a transfer station (4) disposed between said rod making station (3) and said first cutting mechanism (13) and configured to convey said four-length rods (11) from said rod making station towards said first cutting mechanism.

5. The tobacco industry product assembly machine (1) according to claim 1, further comprising a receiving station (5) upstream of the first cutting mechanism (13) and configured to transfer said four-length rods (11) to the first cutting mechanism, and wherein the receiving station comprises a receiving drum (12).

6. The tobacco industry product assembly machine (1) according to claim 1, further comprising a tipping station (9) downstream of the second cutting station (8), configured to join at least one further component (31) of said tobacco industry product to said single-length rods (22,23,24,25) with a tipping paper (T) so as to form tobacco industry product assemblies (32,33).

7. The tobacco industry product assembly machine (1) according to claim 6, further comprising a third cutting station (10) downstream of the tipping station (9), configured to cut the tobacco industry product assemblies (32,33) at a mid-point of the at least one further component so as to form tobacco industry products (37,38,39,40).

8. An operating method of the tobacco industry product assembly machine of claim 1, the method comprising:

providing a four-length rod (11);

cutting said four-length rod into first and second double-length rods (16,17), each double-length rod having respective remote ends;

positioning said first and second double-length tobacco rods by moving at least one of the first and second double-length rods from a first configuration in which they are axially aligned, to a second configuration in which the first and second double-length rods are out of axial alignment and the axes of the first and second double-length rods are parallel and spaced apart, and the remote ends of said first and second double-length rods are substantially aligned with each other, wherein positioning said first and second double-length rods (16,17) adjacent to each other comprises rotating said first double-length rod (16) into alignment with said second double-length rod (17) so that the first and second double-length rods are arranged the second configuration;

cutting said first and second double-length rods into single-length rods (22,23,24,25); and, joining at least one further component (31) of tobacco industry product manufacture to said single-length rods so as to form tobacco industry product assemblies (32,33).

9. The method according to claim 8, wherein rotating said first double-length rod (16) comprises using at least one pivoting arm (20) for rotating said first double-length rod into alignment with said second double-length rod (17) so that the first and second double-length rods are arranged the second configuration.

10. The method according to claim 8, wherein rotating said first double-length rod (16) comprises rotating said first double-length rod by an angle of about 180 degrees around an axis substantially perpendicular to the longitudinal axis of said second double-length rod (17).

11. The method according to claim 8, further comprising cutting the tobacco industry product assemblies (32,33) at a mid-point of the at least one further component (31) so as to form tobacco industry products (37,38,39,40).

12. The method according to claim 8, wherein the four-length rod (11) comprises remote ends, wherein the method comprises cutting said four-length rod into the first and second double-length rods, each double-length rod (16,17) having respective first and second remote ends, wherein the first remote end of each double-length rod corresponds to a respective remote end of the four-length rod and wherein in the second configuration the first remote ends of said first and second double-length rods are substantially aligned with each other.

13. The method according to claim 8, wherein said at least one further component (31) of tobacco industry product manufacture is located between the single-length rods (22, 23,24,25).

* * * * *